US011859874B1

(12) United States Patent
Chute et al.

(10) Patent No.: US 11,859,874 B1
(45) Date of Patent: Jan. 2, 2024

(54) MODIFIED TWO-PHASE REFRIGERATION CYCLE

(71) Applicant: Regi U.S., Inc., Spokane, WA (US)

(72) Inventors: Paul W. Chute, Spokane, WA (US); Allen MacKnight, Spokane, WA (US); Lynn Petersen, Spokane, WA (US); Paul Porter, Colbert, WA (US)

(73) Assignee: Regi U.S., Inc., Spokane, WA (US)

( * ) Notice: Subject to any disclaimer, the term of this patent is extended or adjusted under 35 U.S.C. 154(b) by 804 days.

(21) Appl. No.: 16/284,923

(22) Filed: Feb. 25, 2019

Related U.S. Application Data

(60) Provisional application No. 62/635,457, filed on Feb. 26, 2018.

(51) Int. Cl.

| | |
|---|---|
| ***F25B 11/04*** | (2006.01) |
| ***F25B 9/06*** | (2006.01) |
| ***F25B 1/10*** | (2006.01) |
| ***F25B 9/00*** | (2006.01) |
| ***F25B 1/04*** | (2006.01) |
| ***F25B 1/00*** | (2006.01) |

(52) U.S. Cl.
CPC ..... *F25B 11/04* (2013.01); *F25B 1/10* (2013.01); *F25B 9/00* (2013.01); *F25B 9/06* (2013.01); *F25B 1/00* (2013.01); *F25B 1/04* (2013.01); *F25B 9/008* (2013.01); *F25B 2309/004* (2013.01); *F25B 2309/005* (2013.01); *F25B 2400/14* (2013.01)

(58) Field of Classification Search
CPC ..... B60H 1/3204; F05D 2220/3217; F05D 2220/3218; F05D 2220/3219; F25B 1/00; F25B 1/04; F25B 1/10; F25B 11/04; F25B 2309/004; F25B 2309/005; F25B 2400/14; F25B 49/02; F25B 9/00; F25B 9/008; F25B 9/06
USPC ..... 62/115
See application file for complete search history.

(56) References Cited

U.S. PATENT DOCUMENTS 4,170,116 A * 10/1979 Williams ..... F01K 21/005 60/671
4,945,725 A * 8/1990 Carmein ..... F01B 11/002 60/509
5,027,602 A * 7/1991 Glen ..... F25B 1/00 60/651
7,350,366 B2 * 4/2008 Yakumaru ..... F25B 13/00 62/116

(Continued)

*Primary Examiner* — Elizabeth J Martin
*Assistant Examiner* — Samba Gaye
(74) *Attorney, Agent, or Firm* — Lee & Hayes, P.C.

(57) ABSTRACT

A modified two-phase refrigeration cycle compresses a working fluid, condenses the working fluid into a saturated or supercooled liquid, expands the saturated or supercooled liquid into a two-phase fluid, and evaporates the two-phase working fluid. The modified two-phase refrigeration cycle reduces irreversibilities imposed by conventional refrigeration cycles and extracts energy from the working fluid during the expansion process. For instance, a system that employs the modified two-phase refrigeration cycle includes a two-phase expander to reduce irreversibilities during an expansion process and extract energy. In some instances, the system includes a two-phase compressor to compress two-phase fluids for varying loads and environmental conditions of the system.

19 Claims, 9 Drawing Sheets

(56) References Cited

U.S. PATENT DOCUMENTS

| | | | | |
|---|---|---|---|---|
| 7,896,630 | B2 * | 3/2011 | Grisar | F01C 1/3448<br>418/219 |
| 8,955,343 | B2 * | 2/2015 | Verma | F25B 41/00<br>62/115 |
| 9,389,005 | B2 * | 7/2016 | Takizawa | F04C 23/001 |

* cited by examiner

MODIFIED TWO-PHASE REFRIGERATION CYCLE

CROSS REFERENCE TO RELATED APPLICATIONS

This application claims priority to U.S. Provisional Application No. 62/635,457, filed Feb. 26, 2018, which is incorporated herein by reference.

This application also incorporates by reference U.S. patent application Ser. No. 15/669,589, filed Aug. 4, 2017, which claims priority to U.S. Provisional Application No. 62/394,067, filed Sep. 13, 2016; U.S. Pat. No. 7,896,630, filed Feb. 13, 2007; and U.S. patent application Ser. No. 15/669,625, filed Aug. 4, 2016, which claims priority to U.S. Provisional Application No. 62/394,067, filed Sep. 13, 2016.

BACKGROUND

Refrigeration is the process of removing heat within an environment and transferring it to another environment. In its simplest form, a refrigeration cycle may include a compressor, a condenser, a throttling or expansion valve, and an evaporator. Using a refrigerant or working fluid, such as R134-a or $CO_2$, the working fluid enters the compressor as a low-pressure superheated vapor and is compressed to a high-pressure superheated vapor. The high-pressure superheated vapor then condenses or cools within the condenser to become a high-pressure supercooled liquid. Thereafter, the expansion valve reduces the pressure of the liquid, and in doing so, the liquid becomes a low-pressure two-phase fluid (i.e., including liquid and vapor). Within the evaporator, the low-pressure two-phase fluid absorbs heat from an environment, therein becoming the low-pressure superheated vapor. The low-pressure superheated vapor then reenters the compressor where the refrigeration cycle repeats.

Conventional refrigeration cycles include expansion vales, and as such, their processes are not internally reversible. That is, the expansion valve increases the entropy of the working fluid. However, irreversibilities reduce the cooling capacity of the working fluid and increase an amount of work required by the compressor to compress the working fluid into the high-pressure superheated vapor. While previous efforts have been made to develop isentropic refrigeration cycles, these attempts have been unsatisfactory. For instance, attempts have been made to replace the expansion valve with a turbine to extract energy out of the working fluid and decrease a pressure of the working fluid. However, such attempts have proved impractical as turbines are not suited to handle two-phase fluids.

BRIEF DESCRIPTION OF THE DRAWINGS

The detailed description is described with reference to the accompanying figures. In the figures, the left-most digit(s) of a reference number identifies the figure in which the reference number first appears. The same, or like, reference numbers in different figures indicate similar or identical items.

DETAILED DESCRIPTION

Figure 1:
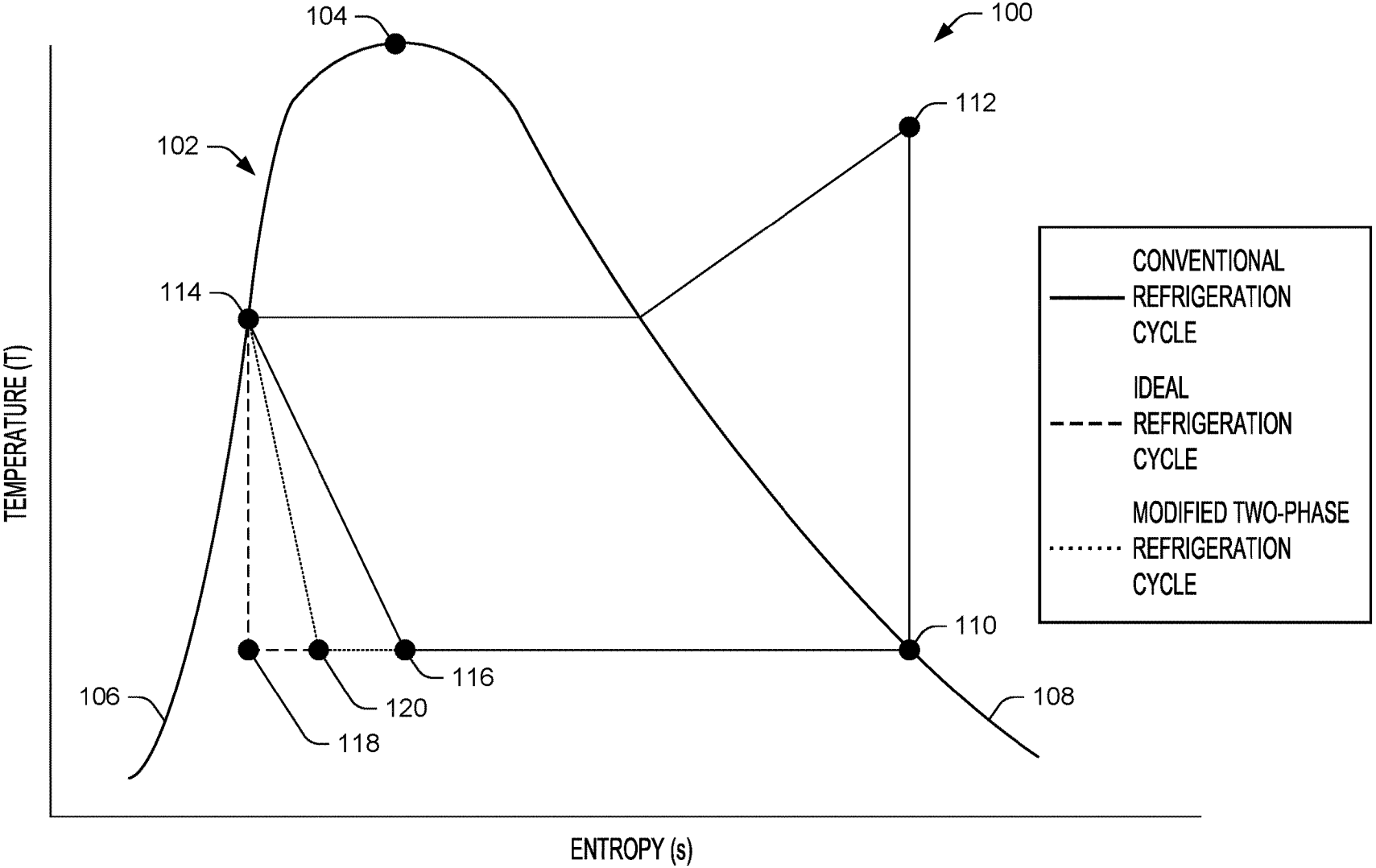
FIG. 1 illustrates an example of a modified two-phase refrigeration cycle on a temperature-entropy diagram, according to an embodiment of the present disclosure.

As mentioned above, expansion valves introduce irreversibilities into conventional refrigeration or vapor-compression cycles. These irreversibilities reduce a refrigeration capacity, or cooling load, of the working fluid (e.g., R134-a). However, reducing the refrigeration capacity of the working fluid affects parameters, or set points, at which the refrigeration cycle is designed to operate. When refrigeration units or air conditioners operate below their designed conditions or set points, the evaporator may fail to boil off the working fluid. In turn, this may cause the compressor to become flooded and operate inefficiently. Moreover, because of the reduced cooling load, without an increased flow of the working fluid throughout the system, the working fluid may fail to absorb heat from an environment to maintain the desired temperature.

Efficiencies may be achieved by expanding the working fluid as an isentropic process to reduce, or potentially eliminate, irreversibilities. Minimizing irreversibilities reduces the amount of the work consumed by the compressor to compress the working fluid into a high-pressure superheated vapor. The performance of a system may therefore be improved by minimizing irreversibilities.

Additionally, efficiency may be further improved by capturing enthalpy of the working fluid and converting it into work through expanding the working fluid. However, in conventional systems, the expansion valve expands the high-pressure saturated liquid without capturing any energy.

This application describes, in part, systems and methods for reducing, eliminating, or substantially eliminating irreversibilities experienced by conventional refrigeration or vapor-compression cycles. For example, this application discusses a modified two-phase refrigeration cycle, and an example system that employs the modified two-phase refrigeration cycle to reduce irreversibilities imposed by conventional refrigeration cycles that use throttling or expansion valves. In other words, compared to conventional refrigeration cycles where entropy increases across the expansion valve, the modified two-phase refrigeration cycle described herein may be designed to reduce the entropy of the working fluid. Additionally, or alternatively, compared to conventional refrigeration cycles, the modified two-phase refrigeration cycle may extract energy from the working fluid during the expansion process. As a result, systems or methods employing the modified two-phase refrigeration cycle may have increased efficiencies by increasing the cooling capacity of the working fluid and/or capturing energy from the working fluid.

In some instances, the modified two-phase refrigeration cycle may utilize an expander to reduce irreversibilities imposed by conventional refrigeration cycles. The expander may include a two-phase expander designed and configured to expand high-pressure saturated or supercooled liquid into a two-phase fluid (i.e., liquid and vapor) at constant or near constant entropies (i.e., isentropic).

The expander may include a low-speed (e.g., 3600 rpm) and/or a positive-displacement expander. The low-speed and/or positive-displacement design may be capable of expanding the high-pressure supercooled liquid or two-phase fluid without suffering erosion, typical issues encountered by turbines (or turbine-generators), which are highly susceptible to damage from impingement of liquid droplets. Consequently, the expander may capture energy contained within a two-phase fluid or low-quality steam without suffering detrimental effects.

Expanding the high-pressure supercooled liquid may also be used to create rotary motion that may be converted into energy, for instance, using an integrated or associated generator. For instance, the expander may include reciprocating vanes that receive the high-pressure supercooled liquid from a condenser and expand the liquid into a low-pressure two-phase fluid. That is, the liquid may expand between the reciprocating vanes. This expansion may cause a shaft to rotate, which may be used to generate electricity and/or power other components of the modified two-phase refrigeration cycle (e.g., compressor).

In some instances, the expander may also be utilized to control a flow rate of the working fluid within the modified two-phase refrigeration cycle. For instance, the expander may optimize the working fluid metered into the evaporator, which may prevent the evaporator and/or the compressor from flooding and operating inefficiently.

Additionally, or alternatively, the modified two-phase refrigeration cycle discussed herein may include or utilize a two-phase compressor to compress the two-phase fluid into a high-pressure two-phase fluid and/or high-pressure superheated vapor. For instance, in conventional systems, compressors are configured to receive low-pressure superheated vapor, and not two-phase fluids. However, through including the two-phase compressor, the modified two-phase refrigeration cycle may be optimized for varying loads and environmental conditions. That is, in some instances, a two-phase compressor may pre-compress the two-phase fluid before the working fluid enters a subsequent compressor configured to compress low-pressure superheated vapor into high-pressure superheated vapor. The two-phase compressor may therefore be utilized to operate at a flow rate according to a required cooling load. As a result, work required by the compressor may be reduced and the overall efficiency may be increased.

Accordingly, systems or methods employing the modified two-phase refrigeration cycle described herein may utilize two-phase expander(s) and/or two-phase compressor(s) to increase an efficiency of conventional refrigeration cycles. More particularly, the two-phase expander may reduce irreversibilities experienced by conventional refrigeration cycles and may capture energy typically dissipated, while the two-phase compressor may compress the two-phase fluid and save work required to compress the low-pressure saturated vapor into high-pressure superheated vapor.

The present disclosure provides an overall understanding of the principles of the structure, function, manufacture, and use of the systems and methods disclosed herein. One or more examples of the present disclosure are illustrated in the accompanying drawings. Those of ordinary skill in the art will understand that the systems and methods specifically described herein and illustrated in the accompanying drawings are non-limiting embodiments. The features illustrated or described in connection with one embodiment may be combined with the features of other embodiments, including as between systems and methods. Such modifications and variations are intended to be included within the scope of the appended claims.

FIG. 1 illustrates a diagram 100 plotted on a temperature-enthalpy chart to compare a conventional refrigeration cycle, an ideal refrigeration cycle, and a modified two-phase refrigeration cycle, according to aspects of the present disclosure. Temperature is shown on the y-axis while entropy is shown on the x-axis.

The conventional refrigeration cycle, the ideal refrigeration cycle, and the modified two-phase refrigeration cycle are shown plotted against a curve 102. The curve 102 includes a critical point 104. The portion of the curve 102 that lies to the left of the critical point 104 indicates a saturated liquid line 106, while the portion of the curve 102 that lies to the right of the critical point 104 indicates a saturated vapor line 108. The locations on the curve 102 to the left of the critical point 104, on the saturated liquid line 106, indicate that the working fluid is in liquid form (i.e., 100 percent liquid), while the locations on the curve 102 to the right of the critical point 104, on the saturated vapor line 108, indicate the working fluid is steam, or vapor (i.e., 100 percent vapor). The area underneath the curve 102 (i.e., the vapor dome) represents a mixture of both liquid and vapor.

In conventional refrigeration cycles, a low-temperature/low-pressure working fluid is compressed to a high-temperature working fluid, between 110 and 112. For instance, at 110, the working fluid may comprise a low-temperature superheated vapor, while at 112, by increasing the temperature and pressure of the working fluid, the working fluid may comprise a high-temperature superheated vapor. Between 110 and 112, the quantity or amount of working fluid remains the same but the volume decreases, thereby causing an increase in pressure and temperature. In some instances, the working fluid may be compressed to a pressure equal to, or substantially equal, to an operating pressure of a condenser. Accordingly, after compression, the high-temperature superheated vapor may be condensed in the condenser (or gas cooler) between 112 and 114. Within the condenser, the high-temperature superheated vapor may become a low-temperature saturated liquid (supercooled liquid), as shown by 114. As a result, the entropy of the working fluid may decrease. Within the condenser the working fluid undergoes a phase change from a vapor to a liquid by rejecting heat into an environment (e.g., outside). From 114, the working fluid enters an expansion valve to decrease in temperature, as shown by 116. Through the expansion valve, an entropy of the working fluid increases. Moreover, beneath the vapor dome, at 116, the working fluid may be two-phases and comprise a mixture of liquid and vapor. As a low-temperature two-phase fluid, the working fluid may enter an evaporator or heat exchanger, between 116 and 110, where heat is absorbed by the working fluid. In doing so, from 116 and 110, the working fluid may become a low-pressure saturated or superheated vapor. As a result, heat may be removed from an environment as the working fluid passes through the evaporator, thereby imparting cooling to the environment.

As noted above and as shown in FIG. 1, in conventional refrigeration cycles, from 114 to 116, the entropy of the working fluid increases and irreversibilities are introduced. These irreversibilities are associated with inefficiencies that reduce the cooling capacity of the working fluid and increase the work required by the compressor (e.g., between 110 and 112). In ideal refrigeration cycles, the entropy of the working fluid does not increase, as shown between 114 and 118. Between these points, the high-temperature saturated liquid (114) becomes a low-temperature two-phase fluid (118) without any increased entropy. Accordingly, in the ideal refrigeration cycle, there are no irreversibilities the cooling capacity of the working fluid does not decrease (i.e., between 116 and 118). As entropy does not increase in an ideal refrigeration cycle, the cooling capacity of the working fluid remains the same.

According to embodiments of the present disclosure, the modified two-phase refrigeration cycle utilizes an expander to expand the working fluid from a high-temperature saturated or supercooled fluid to a low-temperature two-phase fluid. That is, the modified two-phase refrigeration cycle may eliminate the need for expansion valve(s) and instead, may utilize the expander. The expander may impart less irreversibilities into the working fluid commonly experienced by conventional refrigeration cycles and may reduce an entropy of the working fluid, as shown by 120. That is, compared to 116 (i.e., conventional refrigeration cycle), the position of 120 on the temperature-entropy chart represents a reduction in the entropy imparted to the working fluid, thereby increasing the cooling capacity of the working fluid. In turn, the reduction of entropy may increase a coefficient of performance of the modified two-phase refrigeration cycle as compared to a coefficient of performance of conventional refrigeration cycles.

The expander may be configured to output the low-temperature two-phase fluid at the operating pressure of the evaporator. In other words, between 114 and 120, the expander may expand the working fluid to an operating pressure of the evaporator. The expander may comprise a two-phase expander that expands the working fluid into a two-phase fluid. As a low-temperature two-phase fluid, the working fluid may enter the evaporator (or heat exchanger), between 120 and 110, where heat is absorbed. Accordingly, heat may be removed from an environment as the working fluid passes through the evaporator, thereby imparting cooling to the environment. In doing so, from 120 and 110, the working fluid may become a low-pressure superheated vapor prior to being compressed to the high-temperature superheated vapor, from 110 to 112.

In some instances, the modified two-phase refrigeration cycle may utilize a two-phase compressor to pre-compress the working fluid prior to 110, so as configure for varying environmental conditions and load requires.

Moreover, it should be noted that while the integration of the expander may reduce the entropy imparted into the working fluid, irreversibilities or minimal irreversibilities may still be present. That is, as shown in FIG. 1, 120 is not aligned with 114, which represents no entropy change. For instance, the expander may still have, or introduce, minimal frictional pressure drops through converting the high-temperature supercooled liquid into the low-temperature two-phase fluid. However, compared to conventional refrigeration cycles, these irreversibilities may be minimized.

Figure 2:
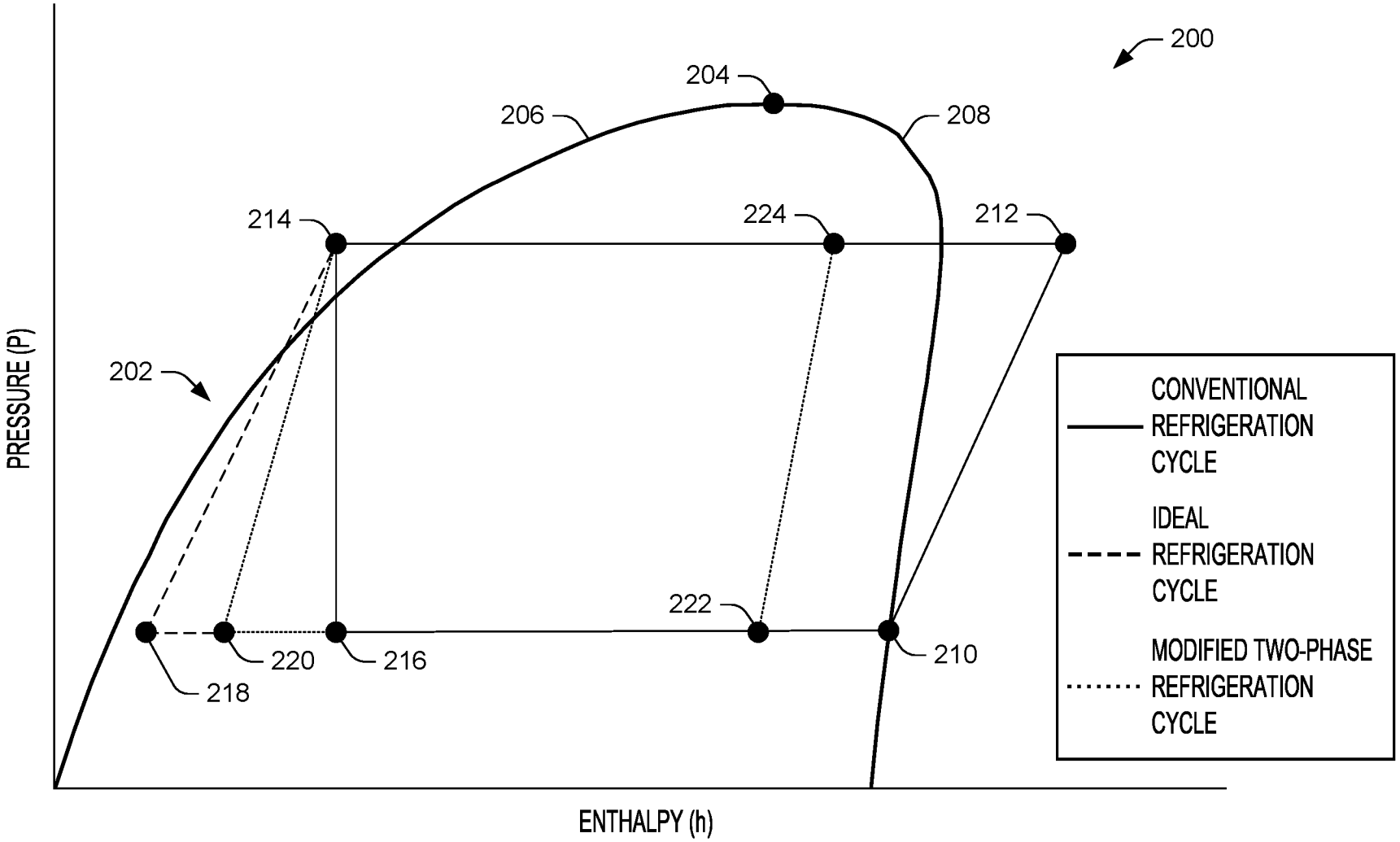
FIG. 2 illustrates an example of a modified two-phase refrigeration cycle on a pressure-enthalpy diagram, according to an embodiment of the present disclosure.

FIG. 2 illustrates a diagram 200 plotted on a pressure-enthalpy chart to compare a conventional refrigeration cycle, an ideal refrigeration cycle, and a modified two-phase refrigeration cycle, according to aspects of the present disclosure. Pressure is shown on the y-axis while enthalpy is shown on the x-axis.

The conventional refrigeration cycle, the ideal refrigeration cycle, and the modified two-phase refrigeration cycle are shown plotted against a curve 202. The curve 202 includes a critical point 204. The portion of the curve 202 that lies to the left of the critical point 204 indicates a saturated liquid line 206, while the portion of the curve 202 that lies to the right of the critical point 204 indicates a saturated vapor line 208. The locations on the curve 202 to the left of the critical point 204, on the saturated liquid line 206, indicate that the fluid is in liquid form (i.e., 100 percent liquid), while the locations on the curve 202 to the right of the critical point 204, on the saturated vapor line 208, indicate the fluid is superheated vapor (i.e., 100 percent vapor). The area underneath the curve 202 (i.e., the vapor dome) represents a mixture of both liquid and vapor.

As discussed above with regard to FIG. 1, in conventional refrigeration cycles, a low-pressure/low-temperature working fluid is compressed to a high-pressure/high-temperature working fluid, between 210 and 212. For instance, at 210, the working fluid may comprise a low-pressure superheated vapor, while at 212, through compressing the working fluid, the working fluid may comprise a high-pressure superheated vapor. Compressing the working fluid between 210 and 212 therefore increases the pressure of the working fluid while decreasing the volume of the working fluid. In some instances, the working fluid may be compressed to a pressure equal to, or substantially equal to, an operating pressure of a condenser. Therein, the working fluid condenses in the condenser between 212 and 214. Within the condenser, the high-pressure superheated vapor becomes a high-pressure saturated or supercooled liquid, as shown by 214. In other words, in the condenser the working fluid undergoes a phase change from a vapor to a liquid as a result of enthalpy (i.e., heat) being lost to an environment. From 214, the working fluid expands through an expansion valve to decrease in pressure, as shown by 216. By expanding the working fluid through the expansion valve an enthalpy of the working fluid remains constant. As a low-pressure two-phase fluid, the working fluid enters an evaporator, between 216 and 210, where heat is absorbed.

As noted above and as shown in FIG. 2, in conventional refrigeration cycles, from 214 to 216, the enthalpy of the working fluid remains the same and no work is captured during the decrease in pressure. That is, as the enthalpy remains constant between 214 and 216 and no work is captured during expansion within the expansion valve. In ideal refrigeration cycles, expanding the working fluid captures all available enthalpies within the working fluid, as shown by 218. Accordingly, in the ideal refrigeration cycle, work is extracted while expanding the high-pressure supercooled liquid to the low-pressure two-phase fluid.

According to embodiments of the present disclosure, the modified two-phase refrigeration cycle utilizes an expander to expand the working fluid between a high-pressure saturated liquid and a low-pressure two-phase fluid. Unlike conventional refrigeration cycles where energy is otherwise dissipated, the modified two-phase refrigeration cycle may extract energy during the expansion of the high-pressure supercooled liquid to the low-pressure two-phase fluid. For instance, as shown in FIG. 2, compared to 216 (i.e., conventional refrigeration cycle), the position of 220 on the pressure-enthalpy chart illustrates that the enthalpy of the working fluid decreases via the expander extracting work during expansion of the working fluid. The expander may be configured to output the low-pressure two-phase fluid at the operating pressure of the evaporator without the need for an expansion valve. Capturing enthalpy within the working fluid may therefore increase a coefficient of performance of the modified two-phase refrigeration cycle compared to a coefficient of performance of conventional refrigeration cycles.

In some instances, the modified two-phase refrigeration cycle may extract energy when the working fluid is two-phases, the working fluid is low-quality liquid (i.e., less than 100 percent liquid), and/or the working fluid is high-quality (i.e., 100 percent liquid). As discussed in detail herein, in some instances, the expander may operably couple to a generator to generate power. The expander may receive the high-pressure superheated liquid and expand the liquid to a low-pressure two-phase fluid while creating energy, and without erosion of components within the two-phase expander. That is, compared to turbines which are highly susceptible to erosion, and are unable to operate with two-phase fluids, the expander implemented in the modified two-phase refrigeration cycle may be configured to utilize two-phase fluids to extract energy while expanding the two-phase fluid to an operating pressure of the evaporator.

Thereafter, as a low-pressure two-phase fluid, the working fluid may enter an evaporator, between 220 and 210, where heat is absorbed. In doing so, from 220 to 210, the low-pressure two-phase fluid may become a low-pressure saturated or superheated vapor. As a result, prior to being compressed to the high-pressure superheated vapor, from 220 to 210, the working fluid may absorb energy and become a superheated prior to being input to the compressor at 210.

Additionally, or alternatively, the modified two-phase refrigeration cycle may impart additional energy savings using a two-phase compressor. As shown in FIG. 2, conventional refrigeration cycles, compressors demand that the working fluid be a low-pressure superheated vapor. However, in some instances, a refrigeration cycle may operate at loads or capacities lower and/or higher than their design. As a result, the compressor, condenser, and evaporator may not operate at designed efficiencies. Integrating a two-phase compressor may compress (or pre-compress) the working fluid which may reduce the work required to be input the compressor. For instance, when operating below designed set points, a two-phase compressor may receive a portion or all of the working fluid at 222. Here, the two-phase compressor may compress the low-pressure two-phase fluid to a high-pressure two-phase fluid, as shown by 224. The high-pressure two-phase fluid may then condense in the condenser, before being input to the expander at 214.

Additionally, or alternatively, the two-phase compressor at 222 may be utilized to pre-compress the working fluid prior to the compression by the compressor at 210. The two-phase compressor may therefore be utilized to pre-compress the working fluid before being compressed by the compressor.

In some instances, the difference in enthalpy between 210 and 222 represents the reduced compressor work required by the compressor for a reduced cooling load. That is, the increased and/or decreased flow rates may be outside operating or set parameters the refrigeration cycle (or system) was designed to operate and the two-phase compressor (or the compressor) may avoid being limited to working with low-pressure superheated vapor.

Moreover, in some instances, the two-phase compressor may be configured to compressor the low-pressure two-phase fluid from 222 to 212, so as to compress the working fluid to a high-pressure superheated vapor.

In some instances, the modified two-phase refrigeration cycle may improve cycle efficiencies, compared to conventional refrigeration cycles, between about 3% to about 35%. In some instances, the coefficient of performance of the system may be calculated by the following equation:

$$COP_{System} = \frac{(h_{210} - h_{220})}{\left(\frac{1}{\eta_{Compressor}}\right) \times (h_{212} - h_{210}) - \eta_{Expander}(h_{214} - h_{218})}$$

where $COP_{system}$ represents the coefficient of performance of the system, $\eta_{compressor}$ represents the efficiency of the compressor, $h_{210}$ represents the enthalpy of the working fluid in conventional refrigeration cycles in the low-pressure saturated vapor state (210 on the diagram 200), $h_{218}$ represents the enthalpy of the working fluid in the modified two-phase refrigeration cycle at the low-pressure two-phase fluid state when implementing the expander (218 on the diagram 200), h 212 represents the enthalpy of the working fluid in refrigeration cycles at the high-pressure superheated vapor state (212 on the diagram 200), (Expander represents the efficiency of the expander, and h 214 represents the enthalpy of the working fluid at the high-pressure supercooled liquid state (214 on the diagram 200).

In turn, the coefficient of performance of the modified two-phase refrigeration cycle may be calculated using the following equation, which represents an efficiency increased compared to a conventional refrigeration cycle:

$$COP_{Improvement} = \frac{(COP_{Expander} - COP_{Conventional})}{(COP_{Expander})} \times 100$$

where $\Delta COP_{Improvement}$ represents the percentage change in the coefficient of performance between a conventional refrigeration cycle and the modified two-phase refrigeration cycle, $COP_{Expander}$ represents the coefficient of performance of the expander, and $COP_{Conventional}$ represents the coefficient of performance of conventional refrigeration cycles, as calculated using the enthalpy of the working fluid after exiting the expansion value (216 in FIG. 2) as shown in FIG. 2.

Accordingly, in comparison to conventional refrigeration cycles, the modified two-phase refrigeration cycle may capture enthalpy in two-phase fluids, for instance, using the expander. Moreover, the increased coefficient of performance may be caused, in part, by reducing the amount of entropy introduced into the two-phase fluid, increasing the cooling capacity of the working fluid, and/or reducing the amount of energy input by the compressor. Additional energy savings may be captured through dynamically changing a mass flow rate in the system via the expander, the compressor, and/or the two-phase compressor, and changing the state points for compression and expansion based on dynamically changing cooling requirements.

Figure 3:
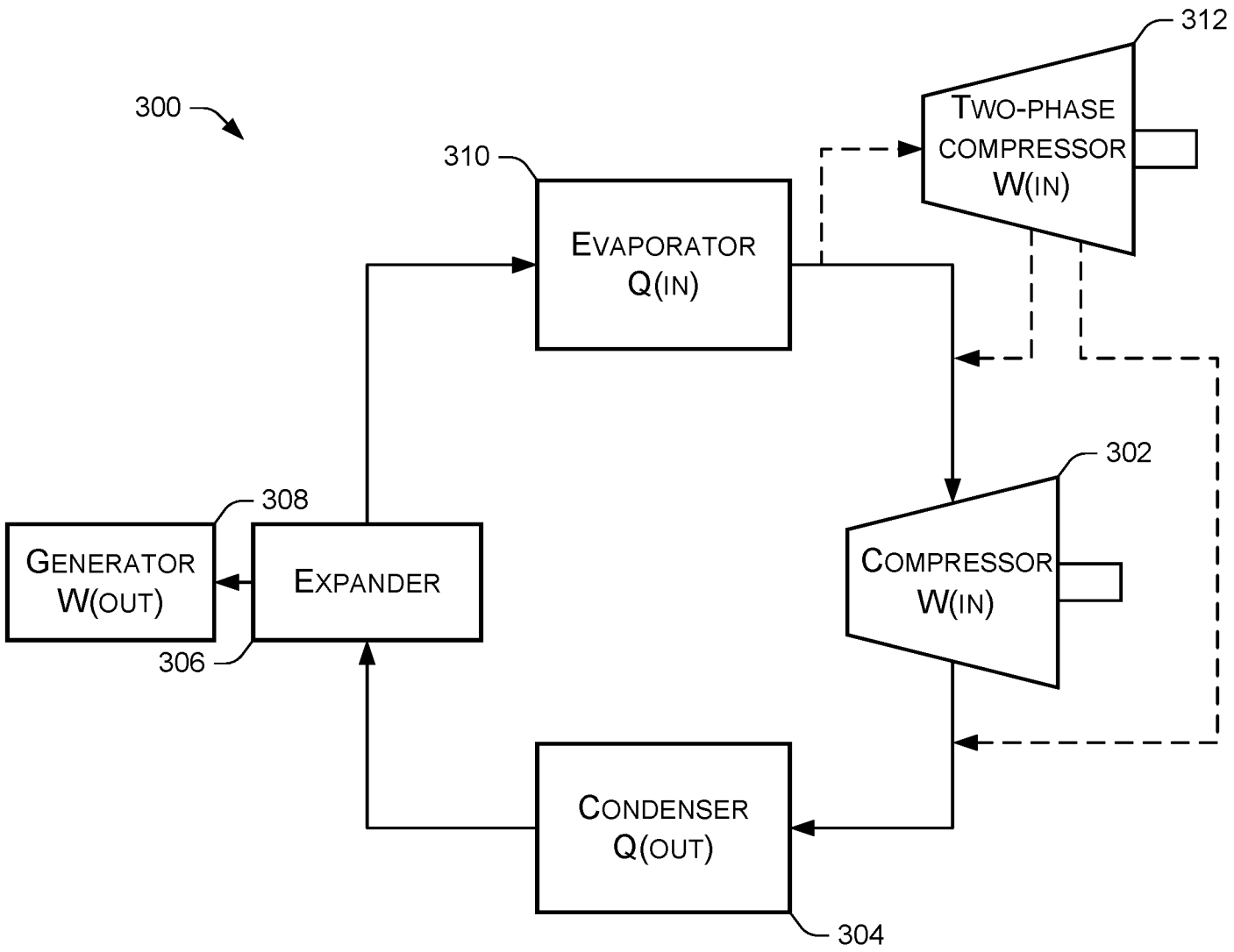
FIG. 3 illustrates an example system usable to implement the modified two-phase refrigeration cycle of FIGS. 1 and 2, according to an embodiment of the present disclosure.

FIG. 3 illustrates an example system 300 according the instant application which, in some instances, may be used to implement the modified two-phase refrigeration cycle as discussed in FIGS. 1 and 2. By way of non-limiting examples, the example system 300 may be usable with a plurality of working fluids, such as R-134a, $CO_2$, R-410A, R-22, Ammonia, or R-32. However, other two-phase fluids may be used in conjunction with the example system 300.

As shown in FIG. 3, the system 300 includes a compressor 302 to compress the low-pressure superheated vapor into a high-pressure superheated vapor (i.e., 100 percent vapor). The compressor 302 may also maintain a specific flow rate of the working fluid throughout the system 300. In some instances, the compressor 302 may include a low-speed and/or positive-displacement compressor and/or may include a two-phase compressor designed and configured to receive two-phase fluids. As a two-phase compressor, the system 300 may be optimized for varying loads and environmental conditions. In other words, compared to conventional compressors that are configured to compress low-pressure superheated vapor and not two-phase fluids, the two-phase compressor may be capable of compressing two-phase fluids within the vapor dome depending on varying loads of the system 300 as well as different environmental conditions.

After being compressed, the high-pressure superheated vapor may enter a condenser 304 to extract heat from the high-pressure superheated vapor. In some instances, the condenser 304 may comprise an air-cooled condenser or a liquid (or water cooled) condenser. In passing through the condenser 304, the high-pressure superheated vapor may condense into a high-pressure supercooled liquid (i.e., 100 percent or substantially 100 percent liquid). The high-pressure supercooled liquid may then be expanded in an expander 306. In some instances, after the high-pressure supercooled liquid passes through the expander 306, the high-pressure supercooled liquid may become a two-phase fluid (e.g., vapor and liquid). In this sense, the expander 306 may be a two-phase expander that expands the high-pressure supercooled liquid into the two-phase fluid. In passing through the expander 306, the working fluid may expand into a two-phase fluid. That is, through the expander 306, the pressure of the working fluid is reduced, which causes the working fluid to expand and reduce in temperature.

In some instances, the expander 306 may comprise a low-speed and/or positive-displacement expander. By using an expander having a low-speed and/or positive-displacement design (i.e., the pressure of the fluid is decreased by increasing its volume), the expander 306 may not suffer from erosion conventionally experienced by turbines. Consequently, the expander 306 may operate with two-phase fluids that includes a mixture of both vapor and liquid without causing appreciable erosion to components of the expander 306. Moreover, a low-speed and/or positive-displacement expander 306 may not impart entropy, or may substantially reduce the entropy imparted, to the two-phase fluid. Decreasing the amount of entropy imparted into the working fluid may increase the cooling capacity of the working fluid.

Expanding the working fluid into the two-phase fluid may create rotary motion that is used to create power, for instance, via a generator 308 operably coupled to the expander 306. Alternatively, the expander 306 may include an integrated generator. For example, the expander 306 may be configured to generate electricity, as discussed in U.S. patent application Ser. No. 15/669,589. As such, utilizing the expander 306, the system 300 may extract energy under the vapor dome where the fluid represents a two-phase fluid, as compared to conventional refrigeration cycles or systems that are unable to extract such energy. In other words, the expander 306 may extract energy that is otherwise dissipated by an expansion valve or throttling valve in conventional refrigeration cycles.

In some instances, the expander 306 may be configured to generate energy from a two-phase fluid having a liquid quality at or above 75 percent. That is, the expander may receive the high-pressure supercooled liquid from the condenser 304, and expand the high-pressure supercooled liquid to a two-phase fluid, having a liquid quality above or about 75 percent. However, in other examples, the expander 306 may be configured to generate energy from a two-phase fluid having a liquid quality from 0 to 100.

After passing through the expander 306, the two-phase fluid may enter an evaporator 310, where the two-phase fluid may absorb heat and become a low-pressure saturated or superheated vapor. That is, the working fluid, after passing through the expander 306 may reduce in temperature, thereby becoming a low-pressure two-phase fluid. In doing so, through the evaporator 310, the working fluid may remove heat from an environment to produce a cooling effect. After passing through the evaporator 310, the two-phase fluid may become a saturated or superheated vapor suitable for reuse by the compressor 302. As such, as the low-pressure superheated vapor enters the compressor 302 and the modified two-phase refrigeration cycle is repeated. However, in some instances, the compressor 302 may include a two-phase compressor capable of receiving a two-phase fluid.

Returning briefly to the expander 306, in some instances, the expander 306 may control the flow rate of the working fluid through the system 300. For instance, the expander 306 may optimize the working fluid metered into the evaporator 310 to not flood or pass too much working fluid into the evaporator 310, and consequently, the compressor 302. By way of example, the expander 306 may operably couple to the compressor 302 via a variable speed drive or direct connection. Additionally, or alternatively, a revolution per minute (RPM) of the expander 306 may be controlled by switching on and off coils in the generator 308. That is, the flow rate of the working fluid through the system 300 may be regulated by adjusting a strength of electric field induced by the generator 308, thereby adjusting the resistance to flow caused by the expander 306. Furthermore, the speed may also be controlled by applying a frictional load on a rotating portion (e.g., shaft) of the expander 306. The expander 306 and/or the compressor 302 may therefore be designed to maintain a specific rate of flow of the working fluid into the evaporator 310.

In some instances, the system 300 may additionally include a two-phase compressor 312. As shown by the dashed line, including the two-phase compressor 312 represents an optional or additional configuration of the system 300. For instance, to accommodate for variable environmental conditions and loads on the system 300, the two-phase compressor 312 may pre-compress the two-phase working fluid from the evaporator 310 to a low-pressure superheated vapor and before entering the compressor 302. In doing so, the pre-compression by the two-phase compressor 312 may compress the two-phase working fluid to the low-pressure superheated vapor for the compressor 302. Additionally, to accommodate for varying loads, FIG. 3 also illustrates that an output of the two-phase compressor 312 may be input directly to the condenser 304. That is, the two-phase compressor 312 may bypass the compressor 302 to accommodate for varying loads of the system 300 and/or environmental conditions. For instance, the system 300 may require a lesser cooling load and the two-phase compressor 312 may accept low-pressure two-phase fluid before the two-phase fluid becomes superheated vapor, thereby compressing the two-phase fluid up to the inlet pressure of the condenser 304.

In some instances, energy generated by generator 308 may be used to power the compressor 302 and/or the two-phase compressor 312. Moreover, in instances where the system 300 includes the two-phase compressor 312, the compressor 302 may or may not comprise a two-phase compressor. Accordingly, in some instances, the system 300 may include the compressor 302, the expander 306, and/or the two-phase compressor 312.

In some instances, the efficiency of the system 300 may be maximized or optimized by including both the two-phase compressor 312 and the two-phase expander 306, where the two-phase compressor 312 and the expander 306 both individually, and collectively, increase the efficiency of the system 300. In some instances, the two-phase compressor 312 and/or the expander 306 may, collectively or individually, improve the efficiency of conventional refrigeration systems between 3% to 35%. For instance, by extracting energy from two-phase fluids (i.e., under the vapor dome), as compared to conventional cycles or systems that are unable to extract such energy, and introducing the two-phase compressor 312 may account for the increased efficiency. Additionally, expanding the working fluid into a two-phase fluid using the expander 308 may reduce irreversibilities and the work consumed by the compressor 302 and/or the two-phase compressor 312 to compress the working fluid into a high-pressure superheated vapor. Including the two-phase compressor 312 also permits compression of two-phase fluids under the vapor dome, thereby adjusting to variable loads and/or changing environmental conditions. In turn, the two-phase compressor 312 may be optimized to match a mass flow rate according to a required cooling load of the system 300.

While the system 300 is described as having certain components, additional components not shown or described may be included to permit performance or operating of the system 300. For instance, the system 200 may include valves, pumps, separators, flash tanks, and so forth. Additionally, while the compressor 302 and/or the expander 306 have been described, other positive displacement technology may be used to extract energy from two-phase fluids. For instance, the system 300 may, additionally or alternatively, use positive-displacement screw technology, positive-displacement piston technology, or other like. Other rotary devices such as radial flow low speed turbines or centrifugal devices capable of handling two-phase fluids may also be used to extract energies from two-phase fluids. Still, the system 300 may include expanders and/or compressors that may not include rotary devices and/or positive-displacement devices.

Figure 4:
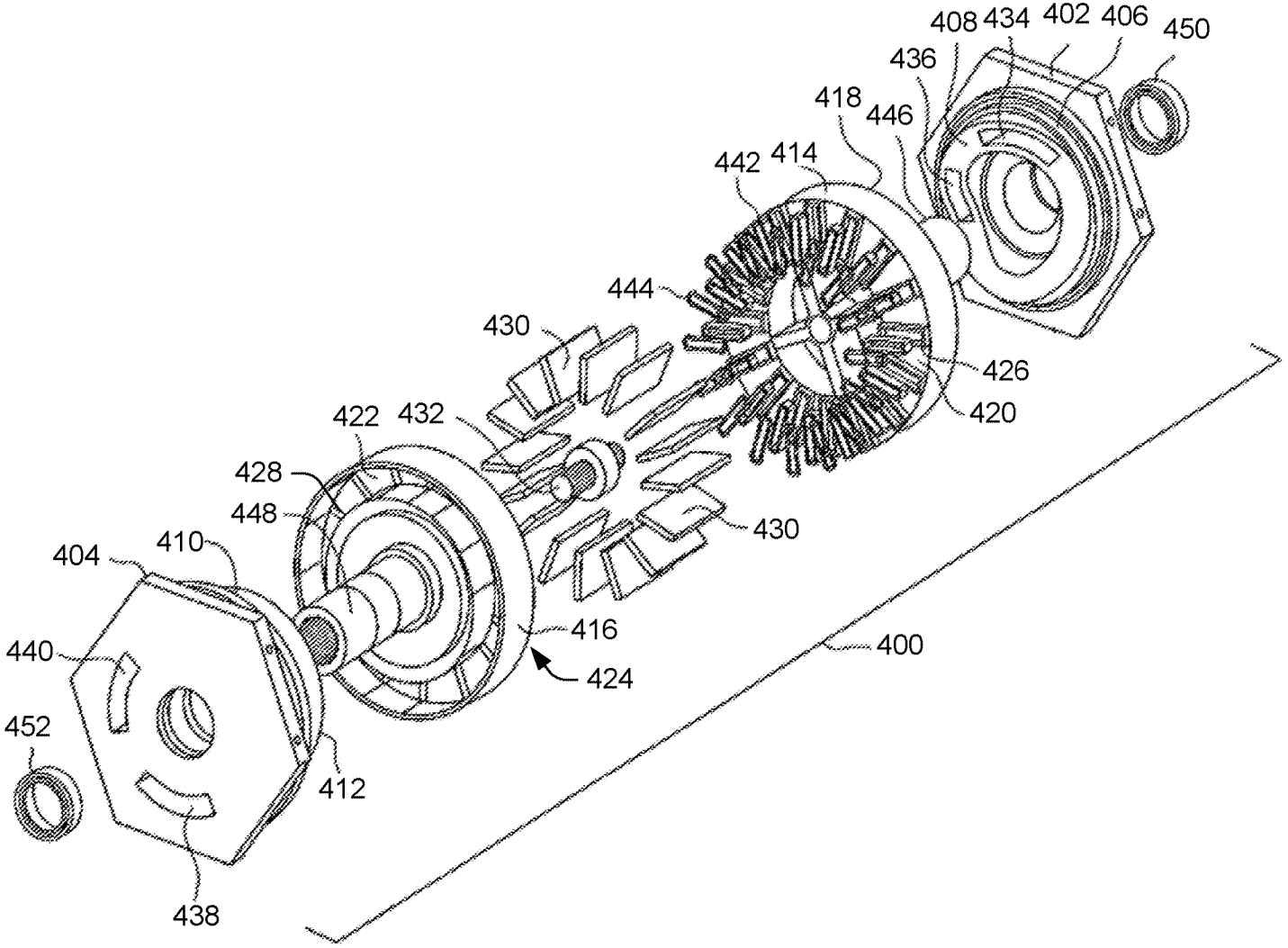
FIG. 4 illustrates an example rotary device usable within the example system of FIG. 3, according to an embodiment of the present disclosure.

FIG. 4 illustrates an example rotary device 400 that may be implemented in the system 300 of FIG. 3. In some instances, the rotary device 400 may be implemented, or usable, as an expander (e.g., the expander 306) and/or a compressor (e.g., the compressor 302 and/or the two-phase compressor 312), as discussed hereinabove and as detailed below with regard to FIGS. 5A and 5B, and FIGS. 6A and 6B, respectively. In some instances, the rotary device 400 may embody a rotary device as illustrated and discussed in U.S. Pat. No. 7,896,630, entitled "Rotary Device with Reciprocating Vans and Seals Thereof."

The rotary device 400 may include a first stator 402 and a second stator 404. The first stator 402 includes a first cam 406 having an undulating cam surface 408 which may, in some instances, include a substantially sinusoidal profile. The second stator 404 includes a second cam 410 having an undulating cam surface 412 which may, in some instances, include a substantially sinusoidal profile.

The rotary device 400 includes a first rotor member 414 and a second rotor member 416. The first rotor member 414 may be in rotating engagement with a periphery of the first cam 406 and has an interior annular surface 418 and an exterior surface 420. The interior annular surface 418 of the first rotor member 414 faces the undulating cam surface 408 of the first stator 402, and the exterior surface 420 of the first rotor member 414 faces the second stator 404 of the rotary device 400. Likewise, the second rotor member 416 may be in rotating engagement with a periphery of the second cam 410 and has an interior annular surface 422 and an exterior surface 424. The interior annular surface 422 of the second rotor member 416 faces the undulating cam surface 412 of the second stator 404, and the exterior surface 424 of the second rotor member 416 faces the first stator 402 of the rotary device 400.

The first rotor member 414 includes a plurality of angularly spaced slots 426 extending therethrough. The second rotor member 416 may also include a plurality of angularly spaced slots 428 extended therethrough.

The rotary device 400 may include vanes 430 reciprocating parallel to an axis of rotation of the first rotor member 414 and the second rotor member 416 to expand and/or compress fluids. The vanes 430 also move rotatably with respect to the first cam 402 and the second cam 404. Individual vanes 430 may extend through individual slots of the plurality of angularly spaced slots 426 in the first rotor member 414 and individual slots of the plurality of angularly spaced slots 428 in the second rotor member 416, respectively. Additionally, individual vanes 430 are in sliding engagement with the undulating cam surface 408 of the first cam 406 as the first rotor member 414. The individual vanes 430 are also in sliding engagement with the undulating cam surface 412 of the first cam 410 as the second rotor member 406 rotates.

In some instances, the adulating cam surface 408 of the first stator 402 and the undulating cam surface 412 of the second stator 404 may be 90-degrees out of phase with one another such that the vanes 430 move parallel to a direction of rotation. In some instances, this phase difference may balance the rotary device 400 such that the rotary device 400 exhibits minimal vibration. The first rotor member 414 and the second rotor member 416 may operably couple to one another via a shaft 432 to ensure coordinated rotation.

The rotary device 400 may include a plurality of chambers sized and configured to receive fluid. For instance, a plurality of chambers may form between the first cam 406, the first rotor member 414, and the vanes 430, between the first rotor member 414, the second rotor member 416, and the vanes 430, and/or between the second rotor member 416, the second cam 410, and the vanes 430. To receive the fluid, the first cam 406 has an inlet port 434 and an exhaust port 436. Similarly, the second cam 410 may include an inlet port 438 and an exhaust port 440.

To seal the chambers, the individual slots of the plurality of angularly spaced slots 426 in the first rotor member 414 may have a seal 442 disposed around a periphery thereof. The seals 442 may serve to seal (e.g., pressurize) the chambers formed between the first rotor member 414, the first cam 406, and the vanes 430. In some instances, individual seals 442 may be held in place via a seal keeper 444 coupled to the exterior face 420 of the first rotor member 414. Additionally, as shown, individual seals 424 may be oblong-shaped to correspond to an exterior profile of the plurality of angularly spaced slots 426. Although not shown, the second rotor member 416 may similarly include seals to seal and pressurize the chambers formed between the second rotor member 416, the second cam 410, and the vanes 430.

Depending upon the application, the chamber volume may change as the vanes 430 move along the undulating cam surface 408 of the first cam 406 and the undulating cam surface 412 of the second cam 410 during a revolution of the first rotor member 414 and the second rotor member 416. Such revolutions result in alternately compressing and/or expanding fluids. For instance, the chambers may receive fluid (e.g., high-pressure supercooled liquid) from a condenser via the inlet port 434 and/or the inlet port 438. When embodied as an expander, the fluid expands within the chambers, resulting in a decrease in pressure. This expansion causes the vanes 430 to move and create rotary motion. To create energy from the rotary motion, the first rotor member 414 and the second rotor member 416 may couple to a shaft 446 and a shaft 448, respectively, which may be coupled to one or more generators. An end of the shaft 446 and the shaft 448 may respectively, engage with a bearing 450 and a bearing 452.

When embodied as a compressor, the vanes 430 may compress the two-phase fluid within the chambers via one or more motors or components of the system 300 (e.g., the expander 306 and/or the generator 308) that drive the rotary device 400

In some instances, the rotary device 400 may be configured as a component capable of handling high-quality liquid, low-quality liquid, and/or two-phase fluids. Additionally, compared to turbines, which require high-velocity fluid to be imparted on the turbine blades, in some instances, the rotary device 400 may receive low-velocity fluids to avoid imparting velocity to the fluid.

As noted above, the rotary device 400 may be configured as a compressor or an expander by changing or reorienting the undulating cam surface 408 of the first cam 406 and/or the undulating cam surface 412 of the second cam 410. Additionally, or alternatively, the rotary device 400 may be configured as a compressor or an expander by changing a location of the intake port 434 and the exhaust port 436, or the location of the intake port 438 and the exhaust port 440.

Figure 5A:
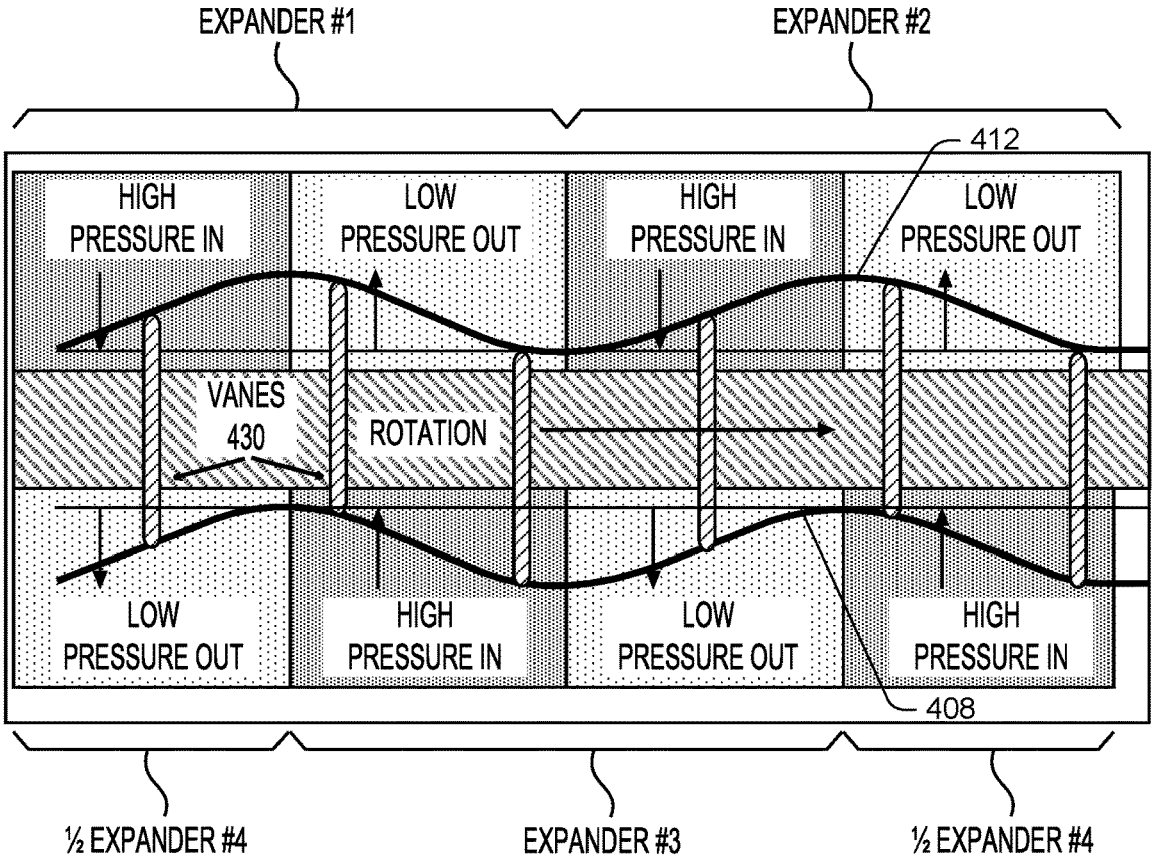
FIG. 5A illustrates an example expansion cycle of the example rotary device of FIG. 4, according to an embodiment of the present disclosure.
Figure 5B:
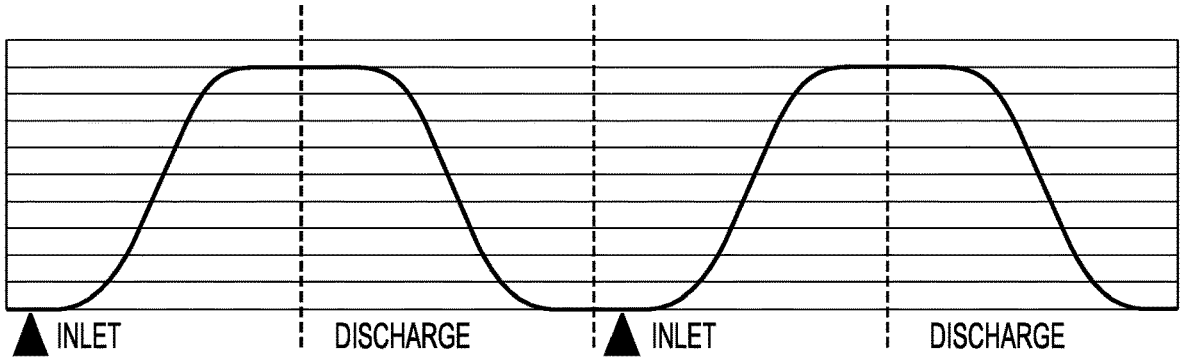
FIG. 5B illustrates a simplified diagrammatic view showing expansion cycles of the example rotary device of FIG. 4 when implemented as an expander, according to an embodiment of the present disclosure.

FIGS. 5A and 5B illustrate inlet and discharge cycles of a rotary device (e.g., the rotary device 400) implemented as an expander (e.g., the expander 306). More specifically, FIG. 5A illustrates two complete intake and discharge expansion cycles on each rotor of the rotary device, while FIG. 5B is a simplified diagrammatic view showing an expansion cycle of the rotary device. In some instances, the expansion cycle may be a combination of four distinct sections, which may allow for the configuration of different expansion ratios. Different porting options into and between chambers may also allow for expansion speed control.

In operation, vanes (e.g., the vanes 430) are axially driven by one or more cams (e.g., the first cam 406 or the second cam 410). The vanes also rotatably move with respect to one or more cams. As shown in FIGS. 5A and 5B, high-pressure fluid is received during intake or an inlet and is trapped between adjacent vanes. The fluid expands during an expansion stroke due to the increasing volume between the vanes. The fluid continues to drive the vanes until a leading vane reaches an exhaust port, at which time the expanded gases are exhausted and the cycle repeats. That is, the fluid expands from a high-pressure (or first pressure) to a low-pressure (or second pressure) to create rotary motion.

For instance, fluid from a condenser may be received through the intake port 434 and/or the intake port 438, as discussed above with regard to the rotary device 400. The fluid is trapped between adjacent vanes 430 the undulating cam surface 408 of the first stator 402 and/or the undulating cam surface 412 of the second stator 410. The fluid is then allowed to expand within chambers as the vanes 430 rotate and move up the undulating cam surface 408 and/or undulating cam surface 412. In some instances, during a rotor revolution, the vanes 430 follow a path that approximates a sinusoidal wave. With a sinusoidal path, during each revolution of a rotor, the volume of the chambers alternately expand and contract. During the expansion cycle, the fluid expands due to an increasing volume between the adjacent vanes 430 and the undulating cam surface 408 of the first stator 402 and/or the undulating cam surface 412 of the second stator 410. As a result, the volume constantly increases as the vanes 430 move along the undulating cam surface 408 and/or undulating cam surface 412 towards the lowest point on the first cam 402 and/or the second cam 404. Once expanded, the fluid may discharge at the exhaust port 436 and/or the exhaust port 440.

Figure 6A:
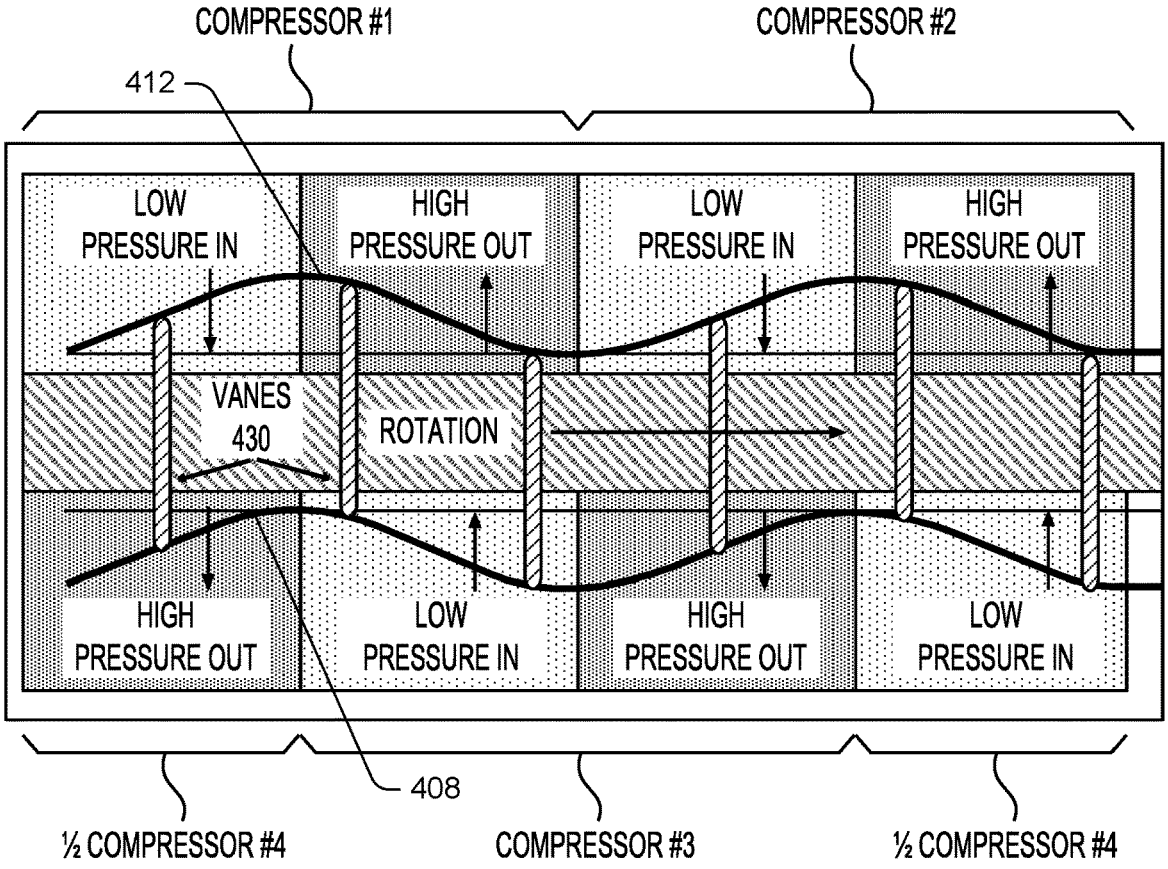
FIG. 6A illustrates an example compression cycle of the example rotary device of FIG. 4, according to an embodiment of the present disclosure.
Figure 6B:
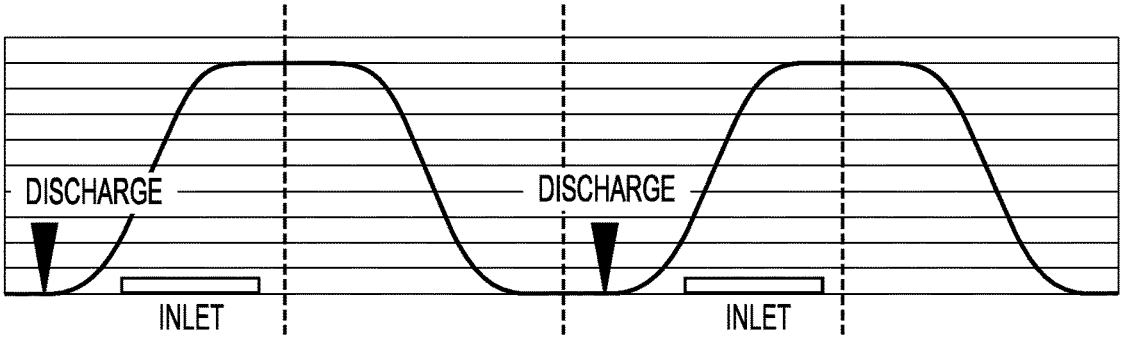
FIG. 6B illustrates a simplified diagrammatic view showing compression cycles of the example rotary device of FIG. 4 when implemented as a compressor, according to an embodiment of the present disclosure.

FIGS. 6A and 6B illustrate inlet and discharge cycles of a rotary device (e.g., the rotary device 400) implemented as a compressor (e.g., the two-phase compressor 312). More specifically, FIG. 6A illustrates two complete intake and discharge compression cycles on each rotor of the rotary device, while FIG. 6B is a simplified diagrammatic view showing the compression cycle of the rotary device. In some instances, the compression cycle may be a combination of four distinct sections, which may allow for the configuration of different compression ratios. Different porting options into and between chambers may also allow for speed control.

In operation, vanes (e.g., the vanes 430) are axially driven by one or more cams (e.g., the first cam 406 or the second cam 410). The vanes also rotatably move with respect to the one or more cams (e.g., the first cam 406 and the second cam 410). As shown in FIGS. 6A and 6B, low-pressure fluid is received during intake or an inlet and is trapped between adjacent vanes. The fluid compresses during a compression stroke due to the decreasing volume between the vanes. The fluid continues to compress until a leading vane reaches an exhaust port, at which time the compressed fluid are exhausted and the cycle repeats. That is, rotary motion causes the fluid to compress from a low-pressure state to a high-pressure state. For instance, fluid from an evaporator may be received through the intake port 434 and/or the intake port 438, as discussed above with regard to the rotary device 400. The fluid is trapped between adjacent vanes 430, the undulating cam surface 408 of the first stator 402 and/or the undulating cam surface 412 of the second stator 410. The fluid is then compressed within chambers as the vanes 430 rotate and move up the undulating cam surface 408 and/or and undulating cam surface 412. In some instances, during a rotor revolution, the vanes 430 follow a path that approximates a sinusoidal wave. With a sinusoidal path, during each revolution of a rotor, the volume of the chambers alternately expand and contract. During the compression cycle, the fluid compresses due to a decreasing volume between the adjacent vanes 430 and the undulating cam surface 408 of the first stator 402 and/or the undulating cam surface 412 of the second stator 410. As a result, the volume constantly decreases as the vanes 430 approach the peak of the undulating cam surface 408 and/or undulating cam surface 412. Once compressed, the fluid is discharged at the exhaust port 436 and/or the exhaust port 440.

Figure 7A:
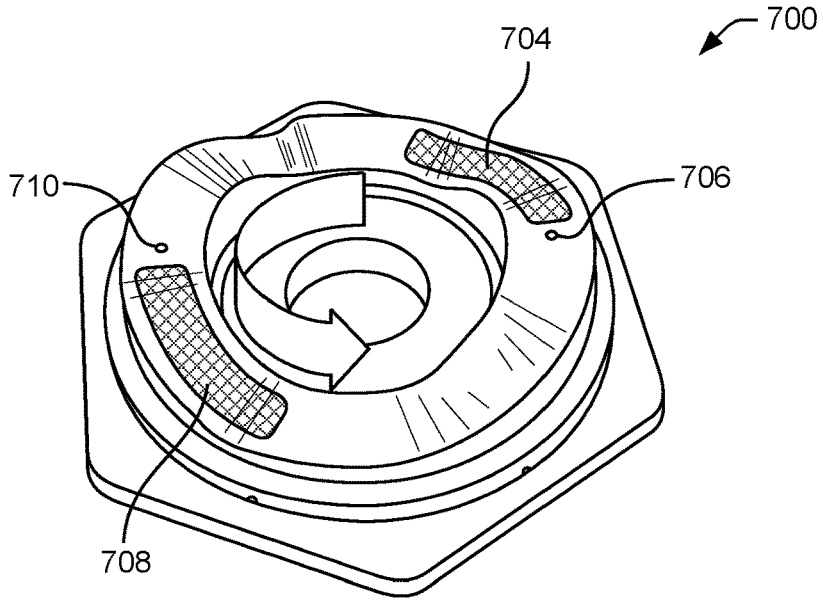
FIG. 7A illustrates an example rotor of the example rotary device of FIG. 4 usable during the example compression cycles of FIGS. 5A and 5B, according to an embodiment of the present disclosure.
Figure 7B:
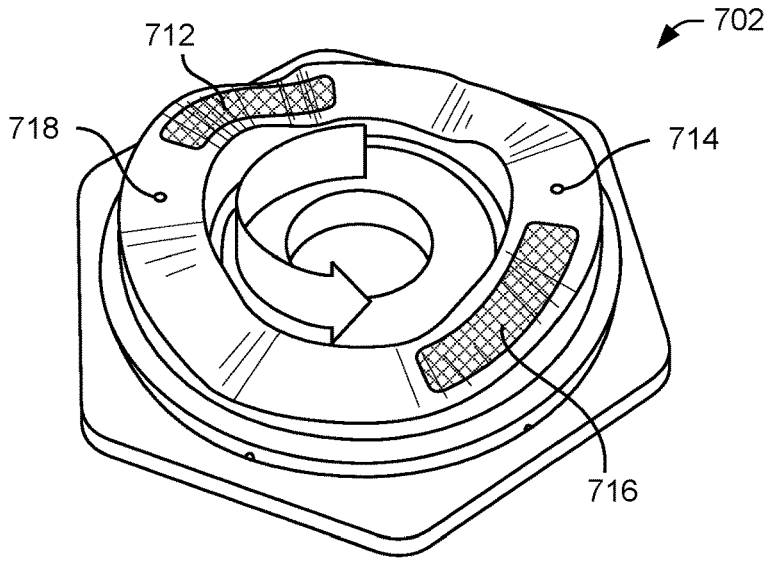
FIG. 7B illustrates an example rotor of the example rotary device of FIG. 4 usable during the example expander cycles of FIGS. 6A and 6B, according to an embodiment of the present disclosure.

FIGS. 7A and 7B illustrate a cam according to compressor and expander configurations. More particularly, FIG. 7A illustrates a cam member 700 of a rotary device in a compressor configuration, while FIG. 7B illustrates a cam member 702 of a rotary device in an expander configuration.

In FIG. 7A, the cam member 700 includes a low-pressure inlet 704, a high-pressure discharge 706, a low-pressure inlet 708, and a high-pressure discharge 710. The low-pressure inlet 704 and the low-pressure inlet 708 may receive fluid from an evaporator. After being compressed to a high-pressure state, as discussed hereinabove, the high-pressure fluid may exit through the high-pressure discharge 706 and the high-pressure discharge 710, respectively.

In FIG. 7B, the cam member 702 includes a low-pressure discharge 712, a high-pressure inlet 714, a low-pressure discharge 716, and a high-pressure inlet 718. The high-pressure inlet 714 and the high-pressure inlet 718 may receive fluid from a condenser. After expanding within the expander to a low-pressure state, as discussed hereinabove, the low-pressure fluid may exit through the low-pressure discharge 712 and the low-pressure discharge 716, respectively.

Figure 8:
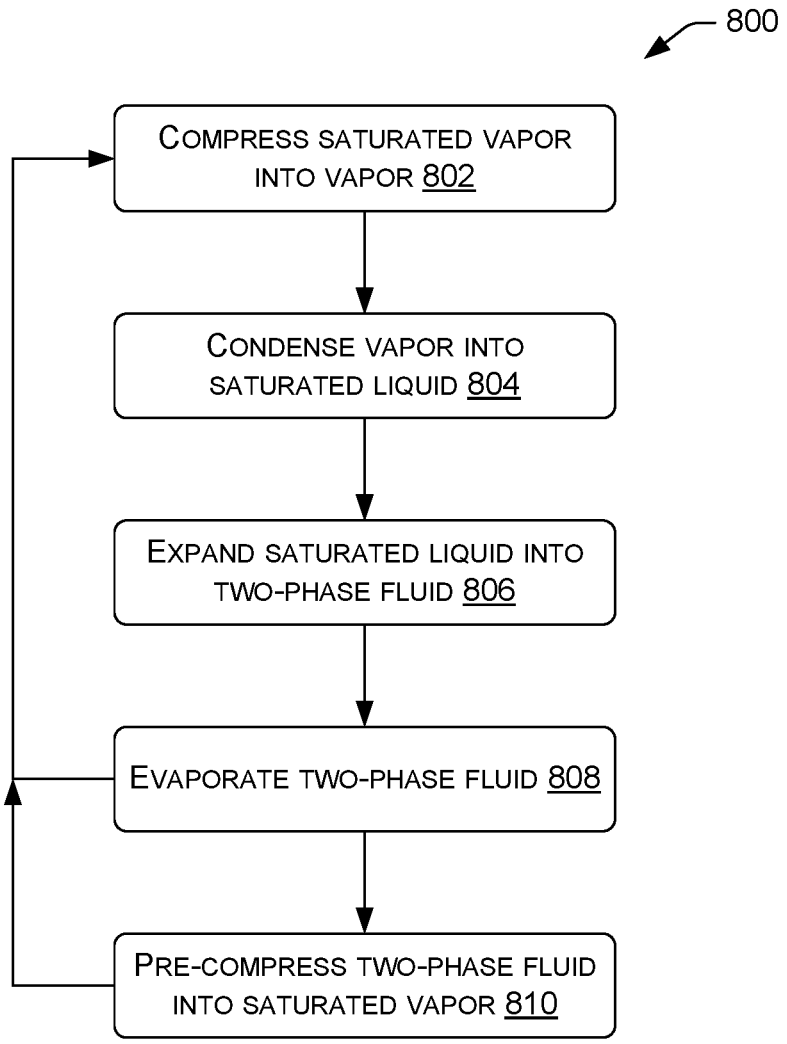
FIG. 8 illustrates an example process showing the modified two-phase refrigeration cycle, according to an embodiment of the present disclosure.

FIG. 8 illustrates an example process 800 according to a modified two-phase refrigeration cycle. In some instances, the process 800 may be implemented using the system 300 described hereinabove.

Beginning at 802, the process 800 may compress saturated or superheated vapor into a high-pressure superheated vapor. For instance, the compressor 302 may compress the saturated or superheated vapor up to an inlet pressure of the condenser 304.

At 804, the process 800 may condense the superheated vapor into a saturated or supercooled liquid. For instance, the condenser 304 may condense the superheated vapor by rejecting heat to an environment (e.g., outside).

At 806, the process 800 may expand the saturated or supercooled liquid in the expander 306. For instance, the expander 306 may receive, from the condenser 304, the saturated or supercooled liquid. In some instances, the fluid may be two-phase or may be high-quality liquid (e.g., 100 percent liquid). For instance, the expander 306 may receive the fluid from the condenser 304 after the fluid becomes supercooled liquid and the fluid has rejected substantially, or substantially all of its heat to the environment and undergoing a phase change from vapor to liquid. In passing through the expander 306, or while passing through the expander 306, the high-pressure supercooled liquid may expand into the two-phase fluid. As noted above, expanding the working fluid into the two-phase fluid may create rotary motion used to create power, for instance, via the generator 308 operably coupled to the expander 306. Accordingly, after passing through the expander 306, the fluid will be lower pressure and a two-phase fluid.

In some instances, the expander 306 may be configured to create power using two-phase fluid. For instance, in some examples, the expander 306 may be configured to create power from fluid having a liquid quality at or below 100 percent. In some examples, the expander 306 may be configured to create power from liquid at a supercooled state down to a quality of above 75 percent. However, in other examples, the expander 306 may be configured to create power from liquid having any quality from 0 to 100.

At 808, the process 800 may evaporate the two-phase fluid. For instance, the evaporator 308 may receive the two-phase fluid and heat may be absorbed by the fluid. In some instances, the process 800 may evaporate the two-phase fluid into saturated or superheated vapor. In doing so, the fluid may become a low-pressure saturated or superheated vapor. From 808, the process 800 may loop to 802 whereby the compressor 302 may compress the saturated or superheated vapor into higher-pressure superheated vapor.

In some instances, from 808, the process 800 may continue to 810 to pre-compress the two-phase fluid into superheated vapor fluid. For instance, a two-phase compressor may be utilized to pre-compress the two-phase fluid into the low-pressure saturated or superheated vapor for use by the compressor (at 802). Hence, after pre-compressing the two-phase fluid at 810, the process may loop to 802. In some instances, pre-compressing the two-phase fluid may optimize the process 800 for varying loads and/or environmental conditions. The pre-compressing at 810 may be done on all, or a portion, of the two-phase fluid received from the condenser 304

Utilizing the process 800, the two-phase compressor 312 and/or the expander 306 may, collectively or individually, improve the efficiency of conventional refrigeration cycles or systems between about 3% to about 35% by extracting energy from two-phase fluids (i.e., under the vapor dome), as compared to conventional cycles or systems that are unable to extract such energy.

Figure 9:
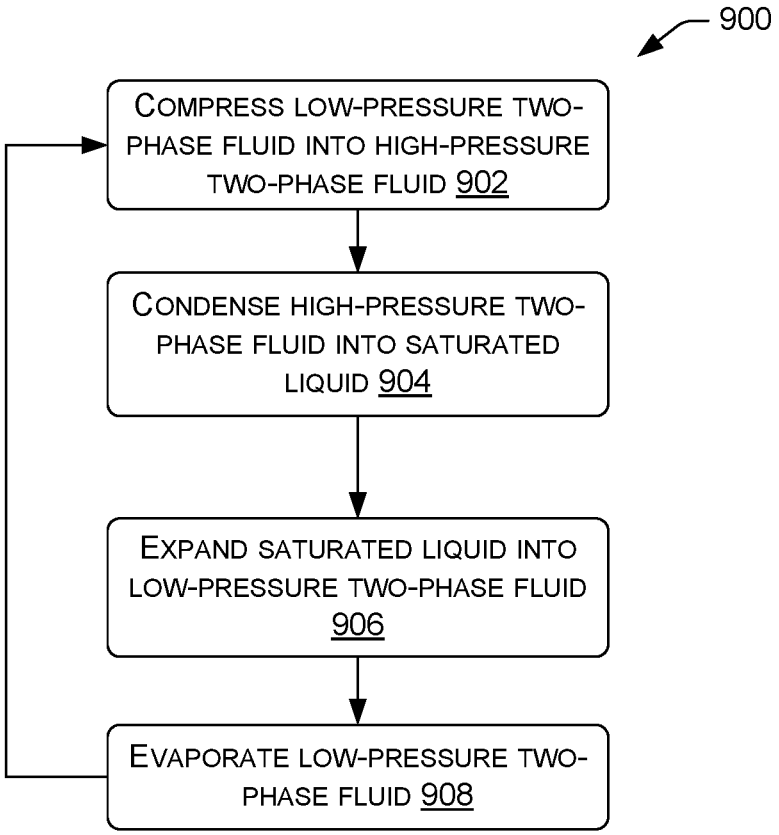
FIG. 9 illustrates an example process showing the modified two-phase refrigeration cycle, according to an embodiment of the present disclosure.

FIG. 9 illustrates an example process 900 according to a modified two-phase refrigeration cycle. In some instances, the process 900 may be implemented using the system 300 described hereinabove. Beginning at 902, the process 900 may compress a low-pressure two-phase fluid into a high-pressure two-phase fluid. For instance, when the system 300 is operating below designed set points, the two-phase compressor may compress the low-pressure two-phase fluid into the high-pressure two-phase fluid At 904, the process 904 may condense the high-pressure two-phase fluid into a supercooled liquid. For instance, the condenser 304 may condense the high-pressure two-phase fluid.

At 906, the process 904 may expand the supercooled liquid in the expander 306 to a low-pressure two-phase fluid. For instance, the expander 306 may receive the fluid from the condenser 304 and in passing through the expander 306, or while passing through the expander 306, the high-pressure supercooled liquid may expand into the low-pressure two-phase fluid. As noted above, expanding the working fluid into the two-phase fluid may create rotary motion used to create power, for instance, via the generator 308 operably coupled to the expander 306.

At 908, the process 900 may evaporate the low-pressure two-phase fluid. For instance, the evaporator 308 may receive the low-pressure two-phase fluid and heat may be absorbed. From 908 the process 900 may loop to 902 whereby the two-phase compressor 302 may compress the low-pressure two-phase fluid into the high-pressure two-phase fluid.

CONCLUSION

While various examples and embodiments are described individually herein, the examples and embodiments may be combined, rearranged and modified to arrive at other variations within the scope of this disclosure. In addition, although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A system, comprising:

an evaporator;

a two-phase compressor coupled to the evaporator, wherein the two-phase compressor is configured to receive a low-pressure two-phase fluid from the evaporator and compress the low-pressure two-phase fluid into a high-pressure two-phase fluid;

a condenser coupled to the two-phase compressor; and a two-phase expander directly coupled to the condenser and the evaporator, wherein the two-phase expander is configured to receive the high-pressure two-phase fluid from the condenser and expand the high-pressure two-phase fluid into the low-pressure two-phase fluid.

2. The system of claim 1, wherein the two-phase expander includes:

a rotor;

vanes engaged with the rotor; and a plurality of chambers separated by the vanes, wherein the plurality of chambers is configured to receive the high-pressure two-phase fluid and expands the high-pressure two-phase fluid into the low-pressure two-phase fluid.

3. The system of claim 1, wherein at least one of:

the two-phase expander is a positive-displacement expander;

the two-phase compressor is a positive-displacement compressor;

the two-phase expander is a radial-flow expander; or the two-phase compressor is a centrifugal compressor.

4. The system of claim 1, further comprising a generator coupled to the two-phase expander to generate electricity from movement of the two-phase expander.

5. The system of claim 1, wherein the two-phase compressor includes:

a shaft;

a rotor coupled to the shaft; and a plurality of vanes that travel in a direction parallel to the shaft.

6. The system of claim 1, wherein at least one of:

the two-phase compressor is further configured to compress the low-pressure two-phase fluid into a high-pressure superheated vapor; or the expander is configured to receive a high-pressure saturated or supercooled liquid fluid and expand the high-pressure saturated or supercooled liquid into the low-pressure two-phase fluid.

7. The system of claim 1, wherein the two-phase compressor is further configured to compress the low-pressure two-phase fluid into at least one of:

the high-pressure two-phase working fluid; or a high-pressure superheated vapor.

8. A system, comprising:

an evaporator;

a two-phase compressor coupled to the evaporator;

a condenser coupled to the compressor; and a two-phase expander directly coupled to the condenser and the evaporator, wherein the two-phase expander is configured to receive a high-pressure two-phase working fluid from the condenser and expand the high-pressure two-phase working fluid into a low-pressure two-phase working fluid.

9. The system of claim 8, wherein the high-pressure two-phase working fluid received by the two-phase expander from the condenser has a liquid quality of at least 95 percent.

10. The system of claim 8, wherein the two-phase compressor is configured to receive the low-pressure two-phase working fluid from the evaporator and compress the low-pressure two-phase working fluid into the high-pressure two-phase working fluid.

11. The system of claim 8, further comprising a compressor coupled to the two-phase compressor and the evaporator, wherein:

the two-phase compressor is disposed between the compressor and the evaporator; and the two-phase compressor is configured to pre-compress the low-pressure two-phase working fluid.

12. The system of claim 11, wherein the two-phase expander operably couples to at least one of the compressor or the two-phase compressor to at least partially power the at least one of the compressor or the two-phase compressor.

13. The system of claim 8, further comprising a generator coupled to the two-phase expander to generate electricity from movement of the two-phase expander.

14. The system of claim 8, wherein:

the two-phase compressor is disposed between the evaporator and the condenser; and the two-phase compressor is configured to compress the low-pressure two-phase working fluid from the evaporator into the high-pressure two-phase working fluid.

15. The system of claim 8, wherein the two-phase compressor is configured to receive the low-pressure two-phase working fluid from the evaporator and compress the low-pressure two-phase working fluid into at least one of:

a high-pressure superheated vapor; or a high-pressure saturated vapor.

16. A method, comprising:

compressing, in a two-phase compressor, a low-pressure two-phase working fluid into a high-pressure two-phase working fluid;

condensing, in a condenser, the high-pressure two-phase working fluid;

expanding, in an expander, the high-pressure two-phase working fluid from the condenser into the low-pressure two-phase working fluid; and evaporating the low-pressure two-phase working fluid.

17. The method of claim 16, further comprising generating, via a movement of the expander expanding the high-pressure two-phase working fluid, power using a generator operably coupled to the expander.

18. The method of claim 16, wherein the expander is a positive-displacement expander.

19. The method of claim 16, wherein the low-pressure two-phase working fluid output from the expander has a liquid quality of at least 75 percent.

* * * * *